US005689934A

United States Patent [19]

Scherer et al.

[11] Patent Number: 5,689,934

[45] Date of Patent: Nov. 25, 1997

[54] METHOD AND SYSTEM FOR WRAPPING A BALE

[75] Inventors: Philip G. Scherer, Ft. Lauderdale; Werner K. Diehl, Parkland, both of Fla.; Gale W. Huson, Glenview, Ill.

[73] Assignee: Mima Incorporated, Glenview, Ill.

[21] Appl. No.: 639,202

[22] Filed: Apr. 26, 1996

[51] Int. Cl.[6] ..... B65B 13/02; B65B 41/18

[52] U.S. Cl. ..... 53/399; 53/449; 53/176; 53/588

[58] Field of Search ..... 53/399, 441, 449, 53/176, 556, 588, 210, 544

[56] References Cited

U.S. PATENT DOCUMENTS

| | | | |
|---|---|---|---|
| 2,937,484 | 5/1960 | Wiman . | |
| 3,525,192 | 8/1970 | Merkel et al. . | |
| 4,343,132 | 8/1982 | Lawless, Jr. . | |
| 4,499,709 | 2/1985 | Miyano et al. . | |
| 4,583,358 | 4/1986 | Krieger et al. . | |
| 4,586,326 | 5/1986 | Igel . | |
| 4,630,435 | 12/1986 | Igel . | |
| 4,641,484 | 2/1987 | Popelka . | |
| 4,769,970 | 9/1988 | Konno | 53/176 |
| 4,817,373 | 4/1989 | Gualchierani . | |
| 4,938,008 | 7/1990 | Salzsauler . | |
| 4,944,502 | 7/1990 | Platzer et al. . | |
| 5,048,271 | 9/1991 | Walton | 53/588 X |
| 5,097,655 | 3/1992 | Thimon | 53/588 |
| 5,125,210 | 6/1992 | Lang et al. . | |
| 5,317,851 | 6/1994 | Lang et al. . | |

FOREIGN PATENT DOCUMENTS

| | | | |
|---|---|---|---|
| 0029977 | 6/1981 | European Pat. Off. . | |
| 0294820 | 12/1988 | European Pat. Off. . | |
| 2948273 | 10/1980 | Germany . | |
| 3737020 | 12/1988 | Germany . | |
| 2269795 | 2/1994 | United Kingdom | 53/176 |
| 2275037 | 8/1994 | United Kingdom | 53/210 |

*Primary Examiner*—Linda Johnson
*Attorney, Agent, or Firm*—Schwartz & Weinrieb

[57] ABSTRACT

A novel method and system for wrapping a bale supported on a platform in a wrapping position with a bale wrapping apparatus including a rotating arm positioned above the bale, a downright member extending downwardly from an outward end portion of the rotating arm, and a wrap carriage movable up and down the downright, wherein the downright and the wrap carriage orbit the bale in the wrapping position as the rotating arm rotates to apply a film or wrap material about the bale. A bale stabilizer, positioned above the bale in the wrapping position, with a plate extendable into contact the bale stabilizes the bale during application of the wrap about the bale. An upender with laterally movable arms and pivoting paddles is positionable to engage and disengage the bale. The upender is movable to raise and lower the clamped bale from and back to the platform, and the paddles are pivotable to rotate the raised bale. The upender includes a carriage movable up and down relative to a base. Each arm is pivotally coupled to the carriage by a second pivot assembly to laterally move the paddles toward and away from each other, and each arm is pivotally coupled to the carriage by a third pivot assembly to pivot the arms between a raised position and a lowered position. The platform for supporting the bale in the wrapping position is mounted on a dolly translatable between a bale press station wherein a bale is loadable onto the platform, the wrapping position, and a conveyor station wherein the bale is unloaded from the platform.

18 Claims, 3 Drawing Sheets

METHOD AND SYSTEM FOR WRAPPING A BALE

FIELD OF THE INVENTION

The invention generally relates to a method and system for wrapping articles with a wrapping apparatus, and more particularly for wrapping a bale formed in a press, transferring the bale to a wrapping position where the bale is wrapped with a film supplied by a wrapping apparatus, and transferring the wrapped bale to a conveyor.

BACKGROUND OF THE INVENTION

Bulk quantities of materials like cotton, polyester and other fibers are often formed into bales with a press and the bale is inserted into a package, which prevents the bale from separating during shipping and processing. In the past, one or more generally opaque bags were disposed over the pressed bale to protect the bale from the environment, and then multiple retention straps were applied over the bagged bale with a strapping machine to retain the form of the bale. In one packaging process, a first bag was unfolded over one end of the bale and a second bag was unfolded over an opposing end of the bale so that the first and second bags overlapped each other. The straps were then applied about the overlapping bags to retain the bale and to seal the overlapping bags. Bales packaged in this way however have several disadvantages. The application of one or more bags about a bale was a laborious and expensive procedure. Strapping applied over the bagged bale sometimes damaged the bags and did not always form a good seal between overlapping bags, which subjected the baled material to contamination from moisture and other impurities. The straps applied to the outer side of the bagged bale were also dangerous to remove since energy stored in the straps was released upon cutting the straps, which sometimes resulted in loose end portions of the cut strap snapping away from the bale in the vicinity of personnel. Moreover, after the straps were removed from the outside of the bags, the bale had a tendency to expand significantly thereby making it very difficult subsequently remove the bags. The bag itself was an expensive and non-recyclable spun bond woven material that obstructed view of the material within the bag.

In view of the discussion above, there exists a demonstrated need for an advancement in the art of wrapping bales.

OBJECTS OF THE INVENTION

It is therefore an object of the invention to provide a novel method and system for wrapping bales that overcomes the problems with the prior art.

It is also an object of the invention to provide a novel method and system for wrapping bales that is economical to practice and manufacture.

It is another object of the invention to provide a novel method and system for wrapping bales that protects the bale from the environment, reduces material and labor costs, provides improved bale visibility, provides safer strap cutting, and provides easily stored and recyclable packaging waste.

It is a further object of the invention to provide a novel method and system for wrapping a bale wherein wrapping is applied over a strapped bale to prevent expansion of the bale before removal of the wrapping, and which provides a strap/wrap pattern that is easier to remove from the bale.

SUMMARY OF THE INVENTION

Accordingly, the present invention is drawn to a novel method and system for wrapping a bale supported on a platform in a wrapping position with a bale wrapping apparatus having a rotating arm positioned above the bale, a downright member extending downwardly from an outward end portion of the rotating arm, and a wrap carriage vertically movable upon the downright member, wherein the downright member and the wrap carriage orbit the bale in the wrapping position to apply a film or wrap material about the bale. The bale wrapping apparatus also includes a bale stabilizer, positioned above the bale in the wrapping position, having a plate extendable toward the bale to contact the bale during application of the wrap about the bale, and retractable away from the bale to permit rotation of the bale. An upender with laterally movable arms and pivoting paddles is positionable to engage or clamp opposing sides of the bale, and the upender is movable to raise the clamped bale from the platform. The paddles are pivotable to rotate the raised bale, which is then lowered back onto the platform. After pivoting, the arms are laterally movable to disengage the paddles from the rotated bale, and the upender is movable away from the bale to permit wrapping of the bale and transfer of bales to and away from the wrapping position. In one embodiment, the upender includes a carriage movable up and down relative to a base. Each arm is pivotally coupled to the carriage by a second pivot assembly to laterally move the paddles toward and away from each other, and each arm is pivotally coupled to the carriage by a third pivot assembly to pivot the arms between a raised position and a lowered position. The upender may include a motor coupled to a drive wheel to move the upender toward and away from the bale. The platform for supporting the bale in the wrapping position is mounted on a dolly translatable between a bale press station wherein a bale is loadable onto the platform, the wrapping position, and a conveyor station wherein the bale is unloaded from the platform.

BRIEF DESCRIPTION OF THE DRAWINGS

These and other objects, features and advantages of the present invention will become more fully apparent upon consideration of the following Detailed Description of the Invention with the accompanying drawings, which may be disproportionate for ease of understanding, wherein like structure and steps are referenced by corresponding numerals and indicators, throughout the several views, and wherein.

DETAILED DESCRIPTION OF THE INVENTION

Figure 1:
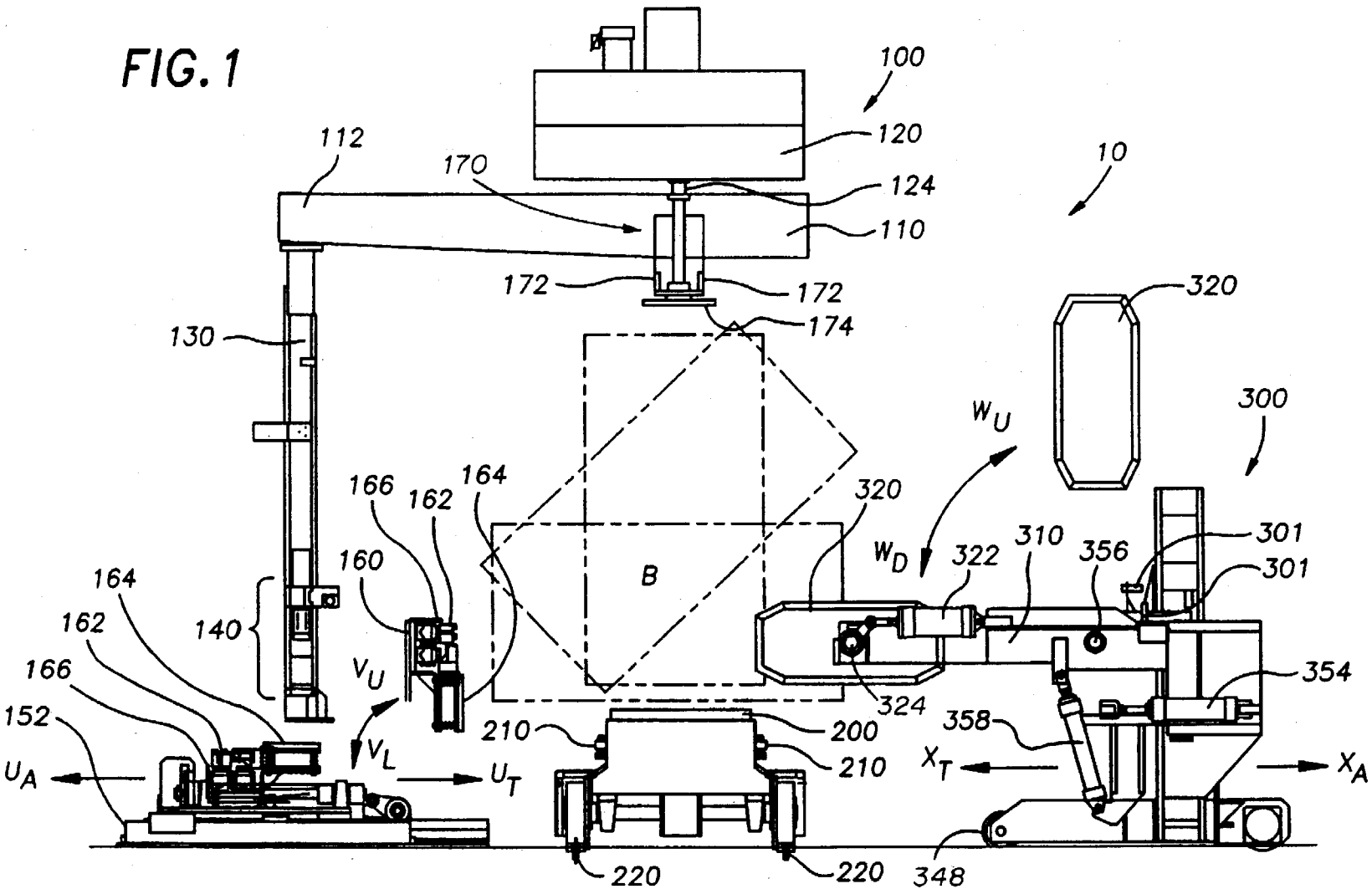
FIG. 1 is a partial side view of a bale wrapping system according to an exemplary embodiment of the invention.

FIG. 1 is a partial side view of a bale wrapping system 10 according to an exemplary embodiment of the invention. The system 10 generally comprises a bale wrapping apparatus 100 for applying wrap about a bale B, a platform 200 for supporting the bale B in a wrapping position, and an upender 300 for rotating the bale B at the wrapping position to permit application of wrapping on all sides of the rotated bale B. In one embodiment, the platform 200 is mounted on a dolly that delivers an unwrapped bale B to the wrapping position for wrapping, and later removes the wrapped bale B from the wrapping position to make room for the next unwrapped bale B. The platform 200 may also be pivotally coupled to a dolly of the type disclosed in copending U.S. patent application Ser. No. 08/621,906 filed on Mar. 26, 1996 and entitled "Method and Apparatus for Transferring a Load". The platform on this dolly is actuatable to an inclined position for loading a bale onto the platform, and the platform is lowered downwardly onto the dolly under the weight of the bale loaded or doffed onto the platform. A platform damping means applies a progressively increasing resistance to the platform as the platform is lowered onto the dolly to reduce any impact on the bale as the bale is doffed onto the inclined platform and as the platform is lowered onto the dolly.

Figure 2:
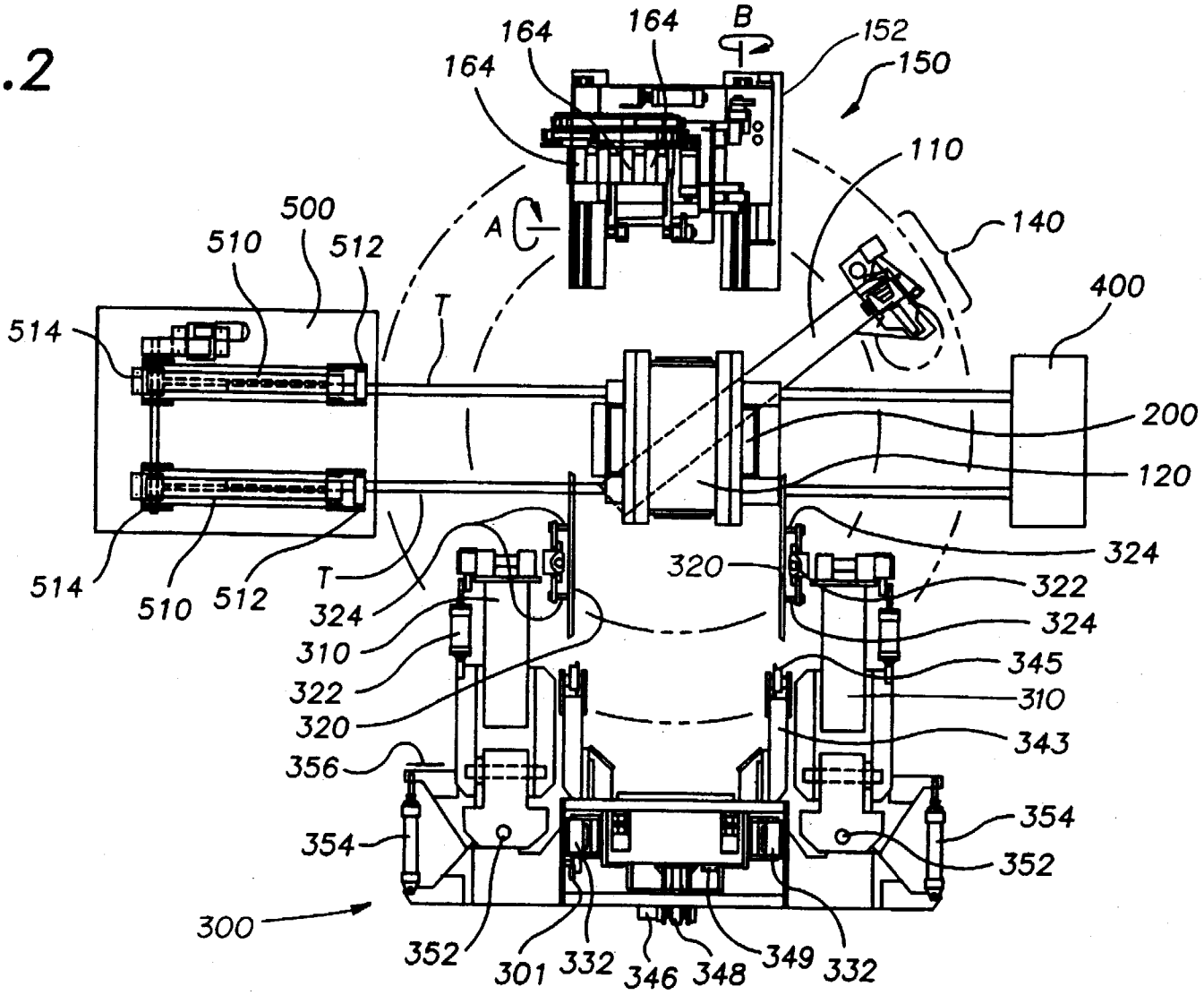
FIG. 2 is a partial plan view of a bale wrapping system according to an exemplary embodiment of the invention.

FIG. 2 is a partial plan view of an another exemplary embodiment including a bale station 400 for loading unwrapped bales B onto the platform 200 of the dolly, and a conveyor station 500 for unloading wrapped bales B from the platform 200 of the dolly wherein a single dolly is translatable back and forth between the bale station 400, the wrapping position 200 and the conveyor station 500. FIG. 2 shows an embodiment wherein the dolly is motor driven along a rail type track T between the stations 400 and 500 and the wrapping position 200. The dolly may include sensors 210, like metal sensors, that cooperate with metal flags 220 located along the track T for detecting the position of the dolly relative to the tracks T as shown in FIG. 1. A photo cell may alternatively be used for some applications. A series of one or more flags 220 may be located proximate the bale station 400, the wrap station below the bale apparatus 200, and the conveyor station 500 and are usable to generate signals as the dolly moves over the flags 220 to indicate the location of the dolly and to increase and decrease the speed of the dolly, to stop the movement of the dolly, and to raise the platform 200 as the dolly approaches the bale station 400. In one embodiment, operation of the dolly is controlled by a programmable logic controller (PLC). In an alternative embodiment, several dollies operate around a circuit delivering unwrapped bales B from the bale station 400 to the wrapping position 200, and removing the wrapped bales B to the conveyor station 500. The bales are generally pressed and secured with strapping at the bale station 400 wherein the strapped bale B is transferred either directly or indirectly onto the dolly. In other embodiments, however, the bale B may be wrapped before application of the strapping.

FIGS. 1 and 2 include side and plan views, respectively, of a wrapping apparatus of the type usable with the exemplary embodiment of the present invention, which in one embodiment is a Cobra™ spiral film wrapping machine available from ITW Mima, an Illinois Tool Works Company, Boca Raton, Fla. Other wrapping machines however like the Ringmaster™ horizontal wrapping ring machine available from Signode, an Illinois Tool Works Company, Glenview, Ill., may also be used with the wrapping system of the present invention. The bale wrapping apparatus generally includes an arm 110 rotatably coupled by a shaft 124 to a rotary drive member, like a variable speed motor not shown in the drawing, mounted and housed in a main frame 120 mounted over the bale wrapping position. The main frame 120 is generally supported by a ground based support frame, not shown in the drawing, or alternatively is suspended from the ceiling or mounted on a wall. A downright member 130 extends downwardly from an outward end portion 112 of the rotating arm 110 and supports a wrap carriage 140 that is translatable up and down the downright member 130. The wrap carriage 140 includes a roll of film, which may be a transparent stretch wrap type film, that is supplied under tension as the wrap carriage orbits the bale B. In one embodiment, the film is maintained at a constant tension by a drag brake coupled to feed a roller over which the film passes. As the arm 110 rotates about the shaft 124, the downright member 130 and wrap carriage 140 orbit about the bale B supported upon the platform 200 at the wrapping position, and the film is fed from the wrap carriage 140 and applied about the bale B. The wrap carriage 140 generally begins at a lower position on the downright 130 and moves upward as the wrap carriage 140 orbits the bale B to spiral wrap the bale B with the film and returns downward toward the bottom of the downright member 130 upon completion of the wrapping process wherein the film is cut and a tail end of the film is adhered to the bale B as further discussed below. A PLC may be used to provide integrated control of the dolly and the bale wrapping apparatus based on sensors that detect the angular position and rotation rate of the rotatable arm 110 and the position of the wrapping carriage 140 along the downright 130 among other sensory input.

The wrapping apparatus 100 includes a wrap sealing apparatus 150 with a main carriage 152 mounted on the floor, which is translatable with a drive motor toward and away from the wrapping position 200 in the direction of arrows $U_T$ and $U_A$ along rails or other guide structure. An intermediate carriage 160 is pivotally mounted along axis A to a pivot support pivotally mounted along axis B to the main carriage 152. The intermediate carriage 160 is movable in the directions of arrows $V_L$ and $V_u$ between a lowered position and a first upright position by a first pneumatic or hydraulic actuator. FIG. 1 shows a portion of the intermediate carriage 160 in the first upright position. The intermediate carriage 160 includes a wrap clamp 162 for clamping a tail of the film, one or more heat sealing pads 164 for heat sealing a tail portion of the film to the bale B, and a film cutter, such as a hot wire, 166 for cutting the tail portion of the film. The intermediate carriage 160 is pivotal farther upward by a second pneumatic or hydraulic actuator to a second upright position wherein the heat pads 164 are raised to a level permitting the contact with the bale 4. In operation, the film tail is initially retained by the wrap clamp 162 and the main carriage is advanced toward the bale B in the wrapping position 200 where the intermediate carriage 160 is pivoted upright substantially as shown in FIG. 1. After the wrapping carriage 140 of the wrapping apparatus rotates about the bale B, beginning from the position shown in FIG. 1, and overlaps an end portion of the film held by the clamp 162, the clamp 162 releases the film tail and the intermediate carriage 160 is pivoted back to the lowered position. After wrapping of the bale B is complete, the intermediate carriage 160 is pivoted to the second raised position and the main carriage 152 is moved toward the bale B to seal the film to the bale B with the heat pads 164. The heat pads 164 are mounted on springs with sensors that indicate that the heat pad 164 is in contact with the bale B. The clamp 162 clamps the film at a point between the bale B and the wrap carriage 140 and the cutter 166 cuts the film. The intermediate carriage 160 then returns to the lowered position and the carriage 160 may move away from the wrapping position 200 ready for the next bale B. Sensors mounted on the main carriage 152 are usable to locate and control the position of the wrap sealing apparatus relative to the wrapping position 200 under PLC control as discussed above. A PLC may also be used to provide integrated control of the dolly and the bale wrapping apparatus and wrap sealing apparatus, which actuates the drive motor, the first and second pivot actuators, the heat pads, film clamp and film cutter.

The wrapping apparatus 100 also includes a bale stabilizer 170 having one or more downwardly extendable and retractable arms 172 coupled to a plate 174, which is rotatable relative to the rotatable arm 110. The bale stabilizer 170 is positioned over the wrapping position 200 and the arms 172 are downwardly extendable to position the plate 174 into stabilizing contact with the bale B, which prevents the bale B from tipping during application of the wrap. The freely rotatable plate 174 positioned on the fixed bale B permits rotation of the wrapping apparatus arm 110, and the plate 174 is retractable from contact with the bale B after application of the wrap. The arms 172 are extendable and retractable by actuatable air cylinders, which may be controlled by a PLC. Not all bales B positioned in the wrapping station require stabilization, and in one embodiment only bales B in an upright position shown in FIG. 1 are stabilized by the bale stabilizer 170.

The upender 300 includes two arms 310 with a corresponding paddle 320 pivotally coupled to a first end portion of each respective arm 310 by a corresponding first pivot assembly that includes a first cylinder 322 for pivoting the paddles 320 about a pin or axis 324. The arms 310 are laterally movable to engage and disengage the paddles 320 with a bale B, and the upender 300 is movable to raise and lower the bale engaged by the paddles 320 to permit pivoting of the paddles 320 to rotate the engaged bale B. The upender 300 is also movable clear of the wrapping apparatus to permit wrapping of the bale B after rotation of the bale B.

Figure 3A:
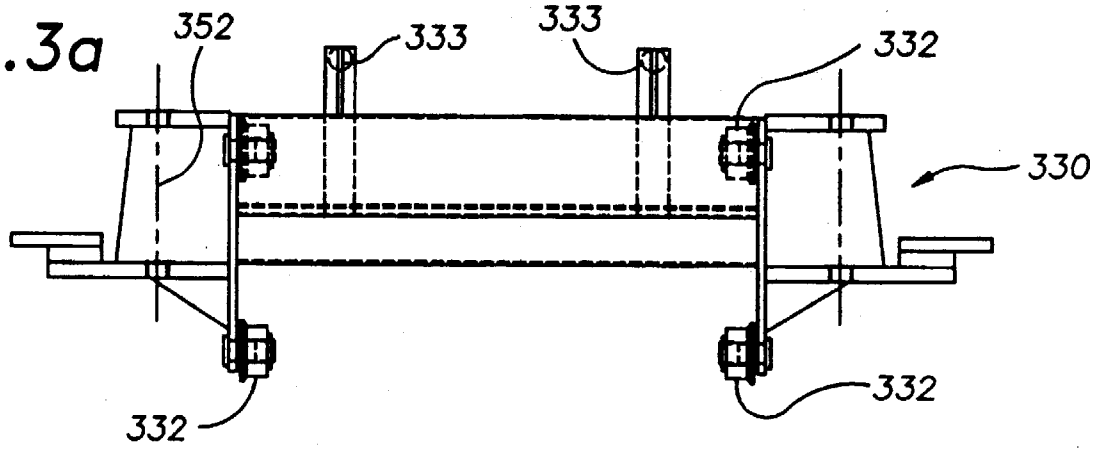
FIG. 3*a* is a partial front view of a carriage for an upender according to an exemplary embodiment of the invention.

In the embodiment shown in FIG. 3*a*, a second portion of each arm 310 is pivotally coupled to a carriage 330 by an interconnecting second pivot assembly wherein the arms 310 are laterally movable about an axis 352 to move the paddles 320 toward and away from each other. The second pivot assembly includes an actuatable pivoting member 350 shown in FIG. 3*c* and a second cylinder 354, which permits the arms 310 to laterally pivot about an axis 352 shown in FIGS. 2, 3*a* and 3*c*. FIG. 2 shows an embodiment wherein the paddles 320 are pivotally mounted about an axis 322 on the arms 310 and retained in a biased position by springs 324. The pivotal paddles 320 compensate for variation in the shape of the bale B to increase the contact surface area between the paddles 320 and the bale B. Each arm 310 is also pivotally coupled to the carriage 330 by a interconnecting third pivot assembly wherein the arms 310 are pivotable about an axis 356 in the direction of arrows $W_D$ and $W_U$ between a raised position and a lowered position. FIG. 2 shows in part the paddle 320 in the raised position. The third interconnecting pivot assembly includes the actuatable pivoting member 350 shown in FIG. 3*c* and a third cylinder 358, which permits the arms 310 to pivot about the axis 356 shown in FIGS. 1, 2, and 3*c*. In the exemplary embodiment, the raised position and the lowered position are substantially horizontal and vertical positions, respectively for moving the arms 310 clear of the bale wrapping apparatus 100 while applying film to the bale B. The cylinders may be pneumatic or hydraulic cylinders, and in the exemplary embodiment the first cylinder 322 is an air cylinder, and the second cylinder 354 and third cylinder 358 are hydraulic cylinders. Each pair of hydraulic cylinders 354 and 358 includes a flow divider valve, which has a slight amount of leakage, to ensure that the respective pairs of cylinders move together. Sensors 301 mounted on the upender 300 are usable to detect the position of the arms 310 and paddles 320, and to provide signals to a PLC for controlling the actuatable cylinders.

Figure 3B:
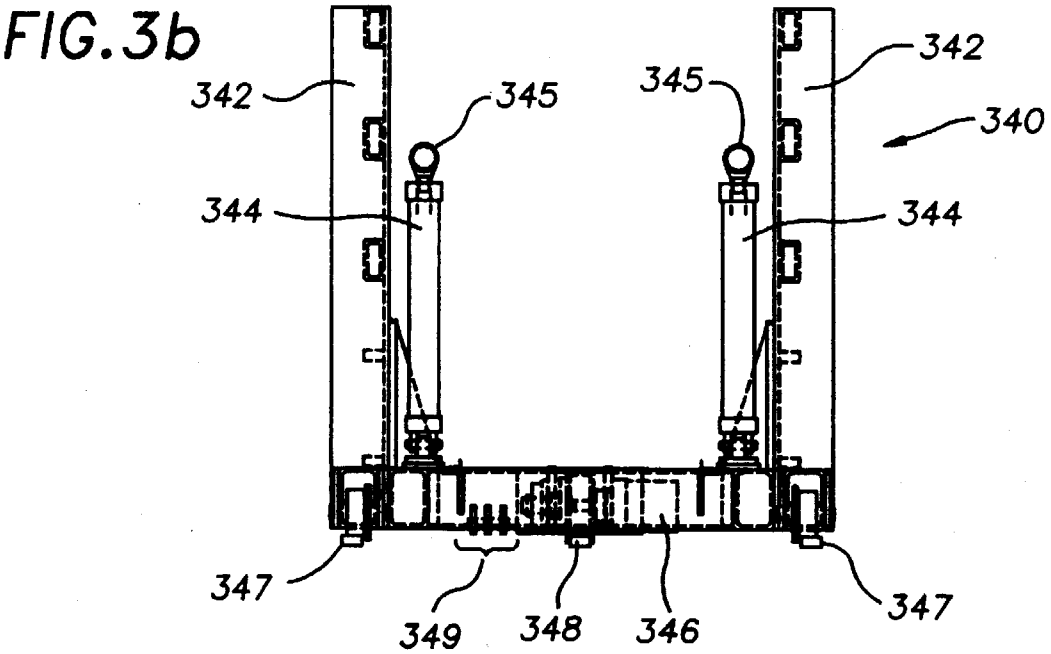
FIG. 3*b* is a partial front view of a base for an upender according to an exemplary embodiment of the invention.
Figure 3C:
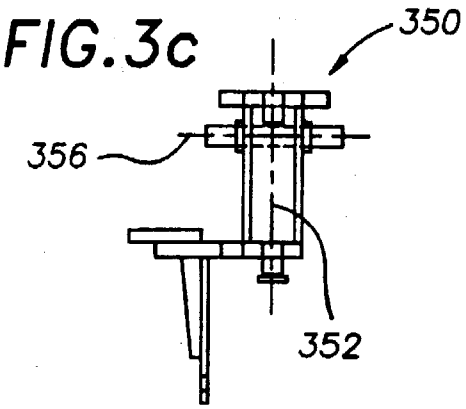
FIG. 3*c* is a partial front view of a pivot assembly for an upender according to an exemplary embodiment of the invention.

FIGS. 3*b* and 3*c* show the carriage 330 movably mounted up and down relative to a base 340 of the upender 300. The base 340 includes uprights 342 with tracks that receive and guide wheels 332 or other sliding members mounted on the carriage 330, which in the exemplary embodiment is a first hydraulic cylinder. The carriage 330 is movable by one or more actuatable cylinders 344 interconnecting the carriage 330 and the base 340 for moving the arms 310 up and down with the carriage 330. The cylinders 344 have end portions 345 coupled to corresponding mounts 333 on the carriage 330. FIG. 2 shows the base 340 having forward extending support legs 343 with rotatable members 345 movable along a rail type track 347 shown in FIG. 3*b*. The base 340 also includes a motor 346, which in one embodiment is a hydraulic motor, coupled to a drive wheel 348 to move the upender 300 in the directions of arrows $X_T$ and $X_A$ toward and away from the bale B. A proportional valve may be coupled to the hydraulic drive motor 346 to permit smooth ramping up and down of the motor speed. Sensors 349 mounted on the base 340 are usable to detect flags on the rails or floor to determine the position of the upender 300 relative to the bale wrapping position 200, and to provide signals to a PLC that controls the drive motor 346. In an alternative embodiment, the upender 300 is fixedly positioned relative to the wrapping apparatus and the upwardly pivotal arms alone move the upender 300 clear of the wrapping apparatus during the bale wrapping process.

The conveyor station 500 includes a pair of inclined rotatable conveyor tracks or belts 510 each having a lower front end portion 512 and a raised rear end portion 514. The lower front end portions 512 are positioned below the platform 200 of the dolly so that the end portions of the bale B extending over sides of the platform 200 are positioned over and onto the rotating belts 510 of the conveyor station 500 as the dolly approaches the conveyor station 500. The rotating belts 510 then transfer the bale B from the platform 200 of the dolly and to another conveyor or loading dock so that another bale 3 may be loaded onto the dolly at the bale station 400. The platform 200 may include a sensor for generating a signal that indicates when the bale B is loaded onto and unloaded from the platform 200.

In one mode of operation, the bale B is supported on the support platform 200 in a first orientation, and the platform 200 is positioned in the wrapping position relative to a bale wrapping apparatus where the wrapping apparatus applies film or wrap material to the side portions of the bale as discussed above. The bale is then rotated on the support platform 200 from the first orientation to a second orientation for wrapping side portions of the rotated bale B not wrapped in the first wrap application. The wrap carriage 140 is located toward the bottom of the downright 130 to facilitate rotation of the partially wrapped bale B from the first configuration to the second configuration. After the sides of the bale B are wrapped, the bale B is moved from the wrapping position. The unwrapped bale B is first secured with retention straps before positioning at the wrapping position, but may alternatively be secured with straps after application of the wrap. The bale B may be stabilized by the bale stabilizer 170 in either or both the first orientation and the second bale orientation, which may depend on the proportions of the bale B. In other operations, stabilization may not be required. The bale B in the second orientation may again be rotated back to the first orientation before moving the bale from the wrapping position.

The bale B is rotated by positioning the arms 310 of the upender 300 on opposing sides of the bale B. In one operation, the upender 300 is first moved from an initial or home position clear of the wrapping apparatus 100 toward the bale B in the wrapping position in the direction of arrow $X_T$ by upender initially are in the arms 310 of the upender 300 initially are in the raised position as shown in FIG. 1. As the upender 300 moves toward the bale B, or after the upender 300 is positioned proximate the bale, the raised arms 310 are lowered in the direction of arrow $W_D$ toward the bale B to position the paddles 320 on opposing sides of the bale B. The lowered arms 310 are then laterally pivoted inward toward the bale B to engage the paddles 320 with opposing sides of the bale B. In one operation, the arms 310 are laterally moved by the cylinders 354, which are actuated for a specified time under PLC control, to ensure that the bale B is fully clamped. After clamping, the upender 300 raises the clamped bale from the platform 200 by raising the carriage 330 coupled to the arms 310 until the bale B is sufficiently clear of the platform 200 to permit rotation. The raised bale B is then rotated 90 degrees by pivoting the paddles 320, after which the carriage and arms 310 are lowered to position the bale B in the wrapping position on the platform 200. The arms 310 are laterally moved away from the bale B to disengage the paddles 320 from the bale B, and the upender 300 is moved clear of the bale in the direction of arrow $X_A$ and the arms 310 are raised upward in the direction of arrow $W_U$ to permit wrapping or movement of the bale B from the wrapping position. When the bale B is in an upright position wherein one dimension of the bale B is greater than the other, it may be advantageous to initially orient or pivot the paddles 320 so that the long dimension of the paddles 320 coincides with the long dimension of the bale B.

In the exemplary system of FIG. 2, the bale B is loaded onto the platform dolly at the bale B station 400 and the dolly is translated along the rails to the wrapping station where it is wrapped as discussed above. The wrapped bale B is then transferred to the conveyor station 500 on the dolly where the bale is unloaded from the platform 200 200 onto the conveyor belts 510. The dolly and empty platform are then translated back over to the bale B station 400 where another bale is loaded onto the platform 200.

While the foregoing written description of the invention enables anyone skilled in the art to make and use what is at present considered to be the best mode of the invention, it will be appreciated and understood by those skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A system for wrapping a bale, comprising:

bale wrapping means for applying wrapping material about a bale disposed at a wrapping station while said bale is disposed in a predetermined orientation;

a platform for supporting said bale disposed at said wrapping station;

an upender carriage disposed adjacent to said wrapping station;

a pair of arms mounted at first portions thereof to said upender carriage, wherein each arm has a bale clamping member mounted upon a second portion thereof;

means for moving said pair of arms, with respect to said upender carriage, between lowered and raised positions, and for moving said pair of arms, with respect to said upender carriage, toward and away from each other;

means for vertically moving said upender carriage between lowered and raised positions; and means for pivotally mounting said bale clamping members between first and second positions with respect to said pair of arms such that when said upender carriage is disposed at said lowered position and said pair of arms are disposed at their lowered positions and moved toward each other while said bale clamping members are disposed at said first positions, said bale clamping members can engage side portions of a bale disposed in a first orientation upon said platform; while when said upender carriage is moved to said raised position so as to remove said bale from said platform, as a result of said bale being secured between said bale clamping members, and thereby permit said bale clamping members to be pivoted to said second positions so as to dispose said bale in a second orientation upon said platform, after which said upender carriage is moved to said lowered position so as to replace said bale upon said platform in said second orientation, and said pair of arms are moved away from each other so as to disengage said bale clamping members from said side portions of said bale, and said pair of arms are moved to said raised positions, further wrapping of said bale while disposed in said second orientation, and with respect to portions of said bale not wrapped while said bale was disposed in said first orientation, can be achieved.

2. The system of claim 1 wherein:

each one of said arms is pivotally connected at first end portions thereof to said upender carriage, which is movable upwardly and downwardly relative to a carriage base, by means of a first pivot assembly whereby said arms and said bale clamping members are pivotally moved between said lowered and raised positions, each one of said bale clamping member is pivotally connected to a second end portion of a respective one of said arms by means of a second pivot assembly whereby said bale clamping members are pivotally moved between said first and second positions so as to reorient said clamped bale between said first and second orientations with respect to said platform, and each one of said arms is pivotally connected at said first end portions thereof to said upender carriage by means of a third pivot assembly whereby said bale clamping members and said arms are pivotally moved toward and away from each other.

3. The system of claim 2, wherein:

said upender base comprises a motor coupled to a drive wheel for moving said upender base toward and away from said bale disposed at said wrapping station;

said means for vertically moving said upender carriage comprises a first hydraulic cylinder interconnecting said upender carriage and said base;

each first pivot assembly for pivoting each one of said arms between said lowered and raised positions comprises a second hydraulic cylinder;

each second pivot assembly for pivoting each one of said bale clamping members between said first and second positions comprises an air cylinder; and each third pivot assembly for pivoting said arms and said bale clamping members toward and away from each other comprises a third hydraulic cylinder.

4. The system of claim 1, wherein said bale wrapping means comprises:

a rotating arm positioned above said platform upon which said bale is disposed so as to be disposed at said wrapping station;

a member extending downwardly from an outward end portion of said rotating arm; and a carriage, having a supply of said wrapping material disposed thereon, movable upwardly and downwardly along said downwardly extending member, whereby said downwardly extending member and said wrapping material orbit said bale disposed at said wrapping station as said rotating arm rotates so as to apply said wrapping material about said bale.

5. The system of claim 1, wherein said bale wrapping means comprises:

a bale stabilizer positioned above said platform upon which a bale is disposed when a bale is disposed at said wrapping station, said bale stabilizer comprising a plate extendable toward said platform so as to contact a bale disposed upon said platform and thereby stabilize said bale during application of said wrapping material about said bale, and retractable away from said platform and a bale disposed thereon so as to permit pivotal movement of said bale from said first orientation to said second orientation thereof.

6. The system of claim 1, further comprising:

a bale loading station at which a bale to be wrapped is loaded onto said platform;

a conveyor station at which a wrapped bale is removed from said platform and conveyed away from said system; and a dolly, upon which said platform for supporting a bale at said wrapping station is mounted, translatable between said bale loading station, said wrapping station, and said conveyor station for transporting a bale from said bale loading station, to said wrapping station for wrapping, and to said conveyor station for conveyance away from said system.

7. A method for wrapping a bale with wrapping material, comprising the steps of:

supporting a bale on a support platform in a first orientation and positioning said bale disposed upon said support platform at a wrapping station;

providing bale wrapping means for applying wrapping material about a bale disposed at said wrapping station and while said bale is disposed in a predetermined orientation;

providing an upender carriage adjacent to said wrapping station wherein said upender carriage is movable between lowered and raised positions;

mounting a pair of arms upon said upender carriage wherein said arms are movable with respect to said upender carriage between lowered and raised positions, and wherein said pair of arms are also movable with respect to said upender carriage toward and away from each other;

mounting a pair of bale clamping members upon said pair of arms wherein said bale clamping members are pivotally movable with respect to said pair of arms between first and second positions;

activating said bale wrapping means so as to wrap side portions of said bale with wrapping material supplied by said bale wrapping means in a first wrap application and while said bale is disposed in said first orientation;

disposing said upender carriage at its lowered position;

disposing said pair of arms at their lowered positions and moving said pair of arms toward each other such that said pair of bale clamping members disposed at said first position can engage said bale disposed upon said support platform at said wrapping station and in said first orientation;

moving said upender carriage to its raised position so as to lift said clampingly engaged bale from said support platform;

rotating said pair of bale clamping members from said first position to said second position such that said bale is rotated from said first orientation to a second orientation;

moving said upender carriage from its raised position to its lowered position so as to place said rotated bale upon said support platform in said second orientation;

moving said pair of arms away from each other so as to disengage said pair of bale clamping members from said bale, and moving said pair of arms to said raised positions so as to remove said pair of arms from the vicinity of said bale;

wrapping side portions of said rotated bale not wrapped during said first wrap application, with wrapping material supplied by said bale wrapping means in a second wrap application; and removing said wrapped bale from said wrapping station.

8. The method of claim 7, further comprising the step of:

securing said bale with retention straps before positioning said bale at said wrapping station.

9. The method of claim 7, further comprising the steps of:

providing a bale loading station adjacent to said wrapping station;

providing a wrapped bale conveyor station adjacent to said wrapping station;

providing a movable dolly, upon which said support platform is disposed, for movement between said bale loading station, said wrapping station, and said conveyor station;

loading a bale to be wrapped onto said support platform of said dolly at said bale loading station such that said bale is disposed in said first orientation;

moving said dolly from said bale loading station to said wrapping station such that said bale is disposed in said first orientation at said wrapping station;

rotating said bale from said first orientation to said second orientation so as to wrap side portions of said rotated bale not wrapped during said first wrap application;

moving said wrapped bale from said wrapping station to said conveyor station by means of said dolly; and unloading said bale from support platform at said conveyor station.

10. The system as set forth in claim 6, further comprising:

track means extending between said bale loading station and said conveyor station for movably supporting said dolly as said dolly is moved from said bale loading station to said bale wrapping station, and from said bale wrapping station to said conveyor station.

11. The system as set forth in claim 10, wherein:

said bale loading station, said bale wrapping station, and said conveyor station are disposed in a rectilinear array with said bale wrapping station interposed between said bale loading station and said conveyor station.

12. The system as set forth in claim 2, wherein:

said first pivot assembly defines a first horizontal axis about which said arms are pivoted;

said second pivot assembly defines a second horizontal axis, disposed parallel to said first horizontal axis, about which said bale clamping members are pivoted; and said third pivot assembly defines a pair of laterally spaced vertical axes about which said arms are pivoted.

13. The method as set forth in claim 7, further comprising the step of:

stabilizing said bale while said bale is disposed in each one of said first and second orientations and during application of said wrapping material about said bale.

14. The method as set forth in claim 7, further comprising the steps of:

mounting said pair of arms upon said upender carriage by means of a first pivot assembly such that said pair of arms are pivotally movable with respect to said upender carriage between said lowered and raised positions about a first pivot axis;

mounting said pair of bale clamping members upon said pair of arms by means of a second pivot assembly such that said pair of bale clamping members are pivotally movable between said first and second positions and with respect to said pair of arms about a second pivot axis; and mounting said pair of arms upon said upender carriage by means of a third pivot assembly such that said pair of arms are pivotally movable toward and away from each other and with respect to said upender carriage about respective third pivot axes.

15. The method as set forth in claim 14, further comprising the step of:

arranging said first, second, and third pivot assemblies such that said first and second axes comprise parallel horizontal axes while said third pivot axes comprise laterally spaced, parallel vertical axes.

16. The method as set forth in claim 9, further comprising the step of:

providing a track interconnecting said bale loading station, said wrapping station, and said conveyor station so as to permit said dolly to travel between said bale loading station, said wrapping station, and said conveyor station.

17. The method as set forth in claim 16, further comprising the step of:

arranging said track in a rectilinear manner such that said bale loading and conveyor stations are disposed upon opposite sides of said wrapping station.

18. The method as set forth in claim 7, further comprising the step of:

providing said upender carriage upon a motor-driven upender base which is movable toward and away from said wrapping station so as to properly position said upender carriage, said pair of arms, and said pair of bale clamping members with respect to said wrapping station and said bale disposed upon said support platform at said wrapping station.

* * * * *